US005357909A

United States Patent [19]

Attinger et al.

[11] Patent Number: 5,357,909

[45] Date of Patent: Oct. 25, 1994

[54] ARRANGEMENT FOR PROTECTING A COOLING SYSTEM FROM EXCESSIVE PRESSURE

[75] Inventors: Thomas Attinger, Stuttgart; Wolfgang Kleineberg, Calw; Reiner Bandlow; Burkhard Raabe, both of Stuttgart, all of Fed. Rep. of Germany

[73] Assignee: Mercedes-Benz AG, Stuttgart, Fed. Rep. of Germany

[21] Appl. No.: 129,747

[22] Filed: Sep. 30, 1993

[30] Foreign Application Priority Data

Oct. 1, 1992 [DE] Fed. Rep. of Germany ..... 4233038

[51] Int. Cl.[5] ..... F01P 3/22

[52] U.S. Cl. ..... 123/41.54; 165/104.32; 220/203; 220/DIG. 32

[58] Field of Search ..... 123/41.54; 220/203, 220/DIG. 32; 165/104.32

[56] References Cited

U.S. PATENT DOCUMENTS 5,197,440 3/1993 Georgs et al. ..... 123/41.54

FOREIGN PATENT DOCUMENTS 0177860 4/1986 European Pat. Off. .
4107183 8/1992 Fed. Rep. of Germany .
2097885 11/1982 United Kingdom .
2253695 9/1992 United Kingdom .

*Primary Examiner*—Noah P. Kamen
*Attorney, Agent, or Firm*—Klaus J. Bach

[57] ABSTRACT

In an arrangement for protecting a cooling system of an internal combustion engine from excessive pressure which cooling system includes a coolant container with a filler mouthpiece with a pressure operated valve mounted on an insert received in the mouthpiece so as to normally close the filler mouthpiece, the mouthpiece has a ventilation opening providing for communication between a gas volume in the coolant container and the filler mouthpiece and including a flow control element which is automatically closed when the coolant container is being filled to permit filling of the container only to the lower end of the mouthpiece extending into the coolant container but is opened by the insert introduced into the filler mouthpiece when the filler mouthpiece is closed. The insert also includes a valve arrangement for controlling the coolant system pressure and various conditions.

10 Claims, 5 Drawing Sheets

ARRANGEMENT FOR PROTECTING A COOLING SYSTEM FROM EXCESSIVE PRESSURE

BACKGROUND OF THE INVENTION

The invention relates to an arrangement for protecting a cooling system of an internal combustion engine from excess pressure.

Such an arrangement is known from the European Patent Application 0 177 860 in which a coolant container is protected from excess pressure by means of a two-stage valve arrangement inserted in a filler mouthpiece. Ahead of the first valve there is provided a float, which disables the first valve in the case of an excessive rise of the cooling water level. Pressure balancing can therefore be achieved only by way of the second valve which is designed to open at a higher pressure than the first valve. It is also proposed that a throttle opening should be provided between the highest point in the coolant container and the region in front of the first valve to ventilate the gas volume enclosed in the coolant container.

This arrangement has the disadvantage that there is no reliable protection against overfilling when topping up with coolant. Although the inlet cross-section is reduced from a certain fill level by the raising of the float, the arrangement does not prevent further slow filling. In addition, the air contained in the coolant container can escape via the throttling opening so that no air buffer volume, which could act as a protection against excessive filling, can form.

A cooling water balance container with a simple arrangement for protecting against overfilling is known from the German Patent Specification 41 07 183, in which an excess pressure valve, which is closed during filling, is arranged in a ventilation conduit.

The object of the invention is to provide an arrangement for protecting a cooling system of an internal combustion engine from excess pressure in a simple manner in such a way that, on the one hand, excess pressure protection is insured for the complete gas and fluid volume enclosed in the cooling system in all operating ranges and, on the other hand, overfilling of the coolant container is safely prevented.

SUMMARY OF THE INVENTION

In an arrangement for protecting a cooling system of an internal combustion engine from excessive pressure which cooling system includes a coolant container with a filler mouthpiece with a pressure operated valve mounted on an insert received in the mouthpiece so as to normally close the filler mouthpiece, the mouthpiece has a ventilation opening providing for communication between a gas volume in the coolant container and the filler mouthpiece and including a flow control element which is automatically closed when the coolant container is being filled to permit filling of the container only to the lower end of the mouthpiece extending into the coolant container but is opened by the insert introduced into the filler mouthpiece when the filler mouthpiece is closed. The insert also includes a valve arrangement for controlling the coolant system pressure and various conditions.

This arrangement performs both functions, i.e., it provides for fill level protection and excess pressure protection including a flow control element in the ventilation passage. As the flow control element is closed for filling the coolant container, a gas buffer forms in the upper region of the coolant container. This ensures that the coolant container can only be filled up to the lower edge of the filler mouthpiece. If, there is a further supply of cooling fluid, the fluid level continues to rise only in the filler mouthpiece. After the closing of the cooling fluid container, the control element is opened so that a pressure balance is possible between the gas volume and the filler mouthpiece during operation of the internal combustion engine.

Further features and advantages the invention are apparent from the description.

DESCRIPTION OF THE PREFERRED EMBODIMENT

Figure 1:
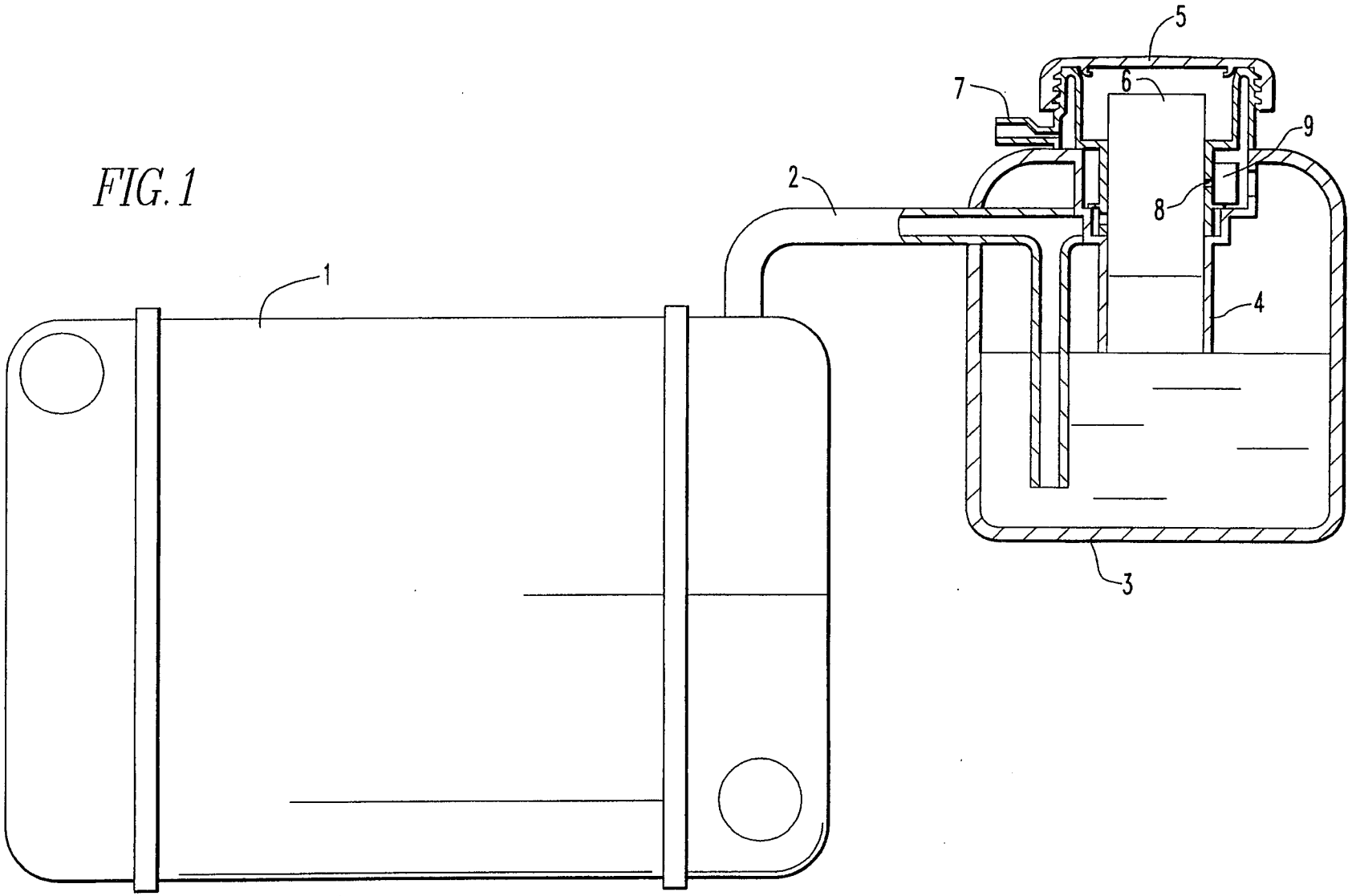
FIG. 1 shows a diagrammatic representation of a radiator of an internal combustion engine with balance container.

FIG. 1 shows a radiator 1 of a cooling system (not shown in detail) of an internal combustion engine. The radiator 1 is connected to a coolant container forming a balance container 3 via a fill hose 2 which is mounted at the highest point in the cooling system. For filling with coolant, the upper region of the balance container 3 is provided with a filler mouthpiece 4 which can be closed by means of a closing cap 5. A two-stage valve arrangement 6, which is connected via an overflow 7 to atmosphere, is arranged in the upper region of the filler mouthpiece 4 to protect the cooling system excess pressure. In addition, a ventilation opening 8, which can be closed off or opened by means of a flow control element 9, is provided in the filler mouthpiece 4.

Figure 2:
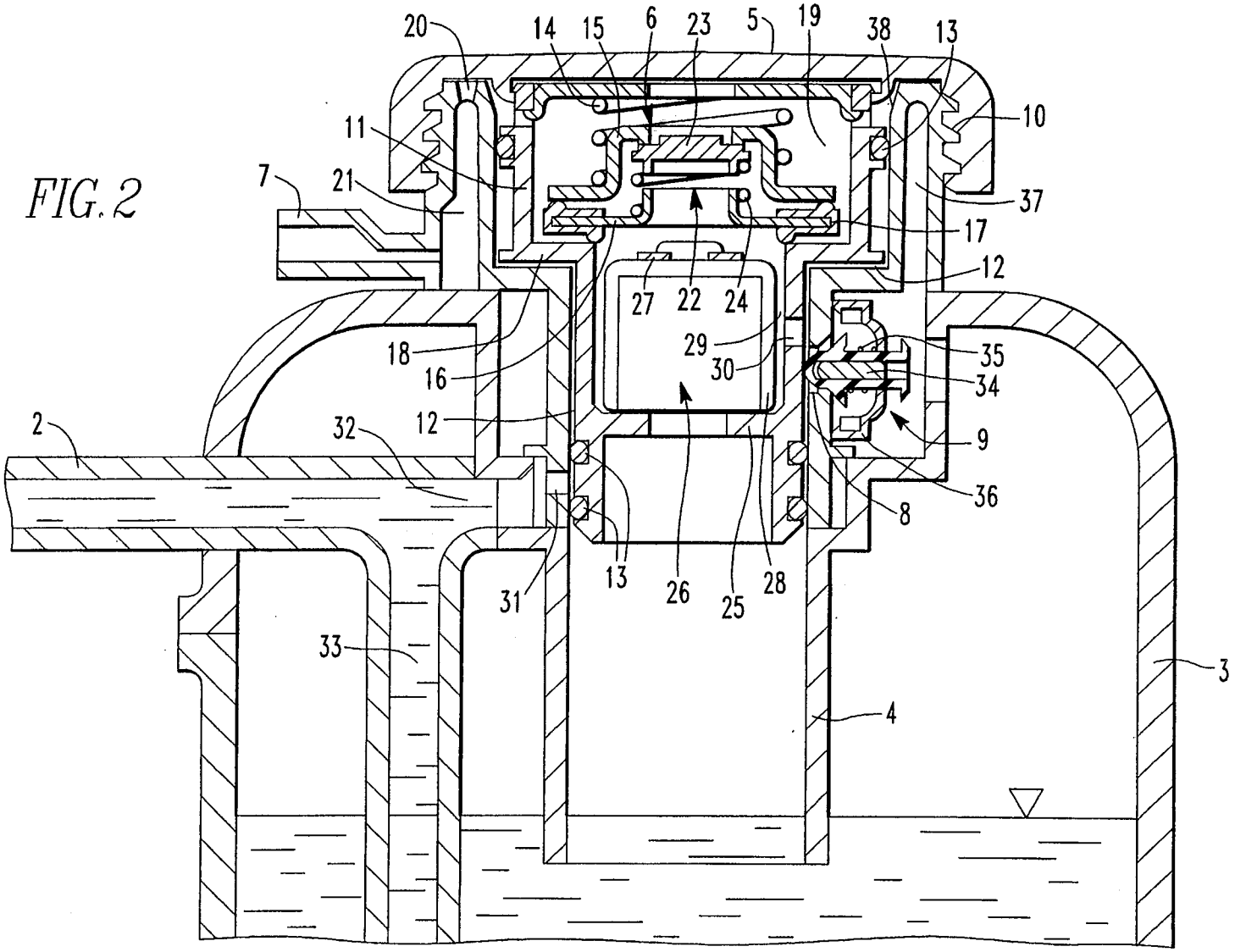
FIG. 2 shows, in section, a part of the balance container of FIG. 1 with the valve insert inserted in the filler mouthpiece.
Figure 3:
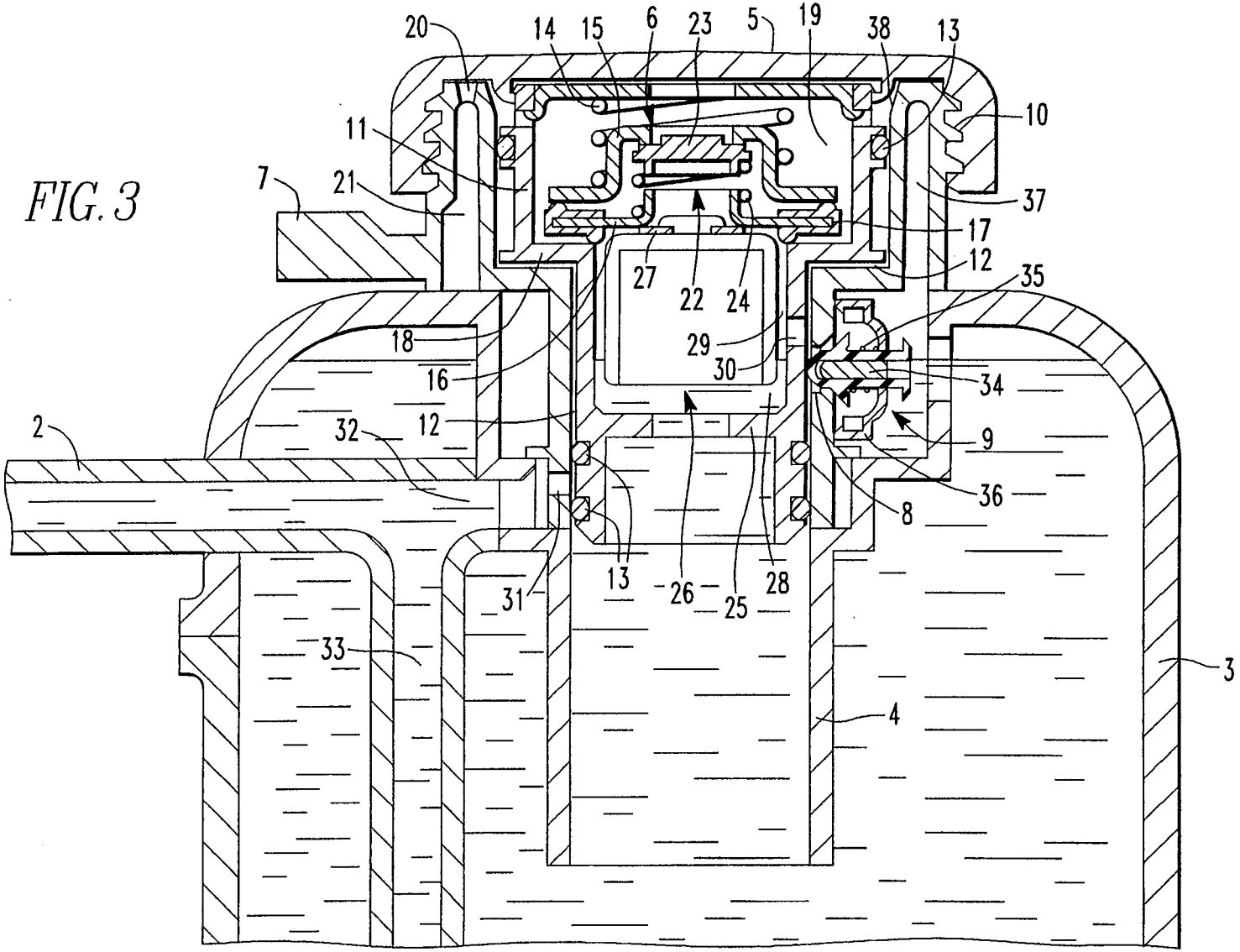
FIG. 3 shows, in section, the balance container of FIG. 2 with raised cooling fluid level.
Figure 4:
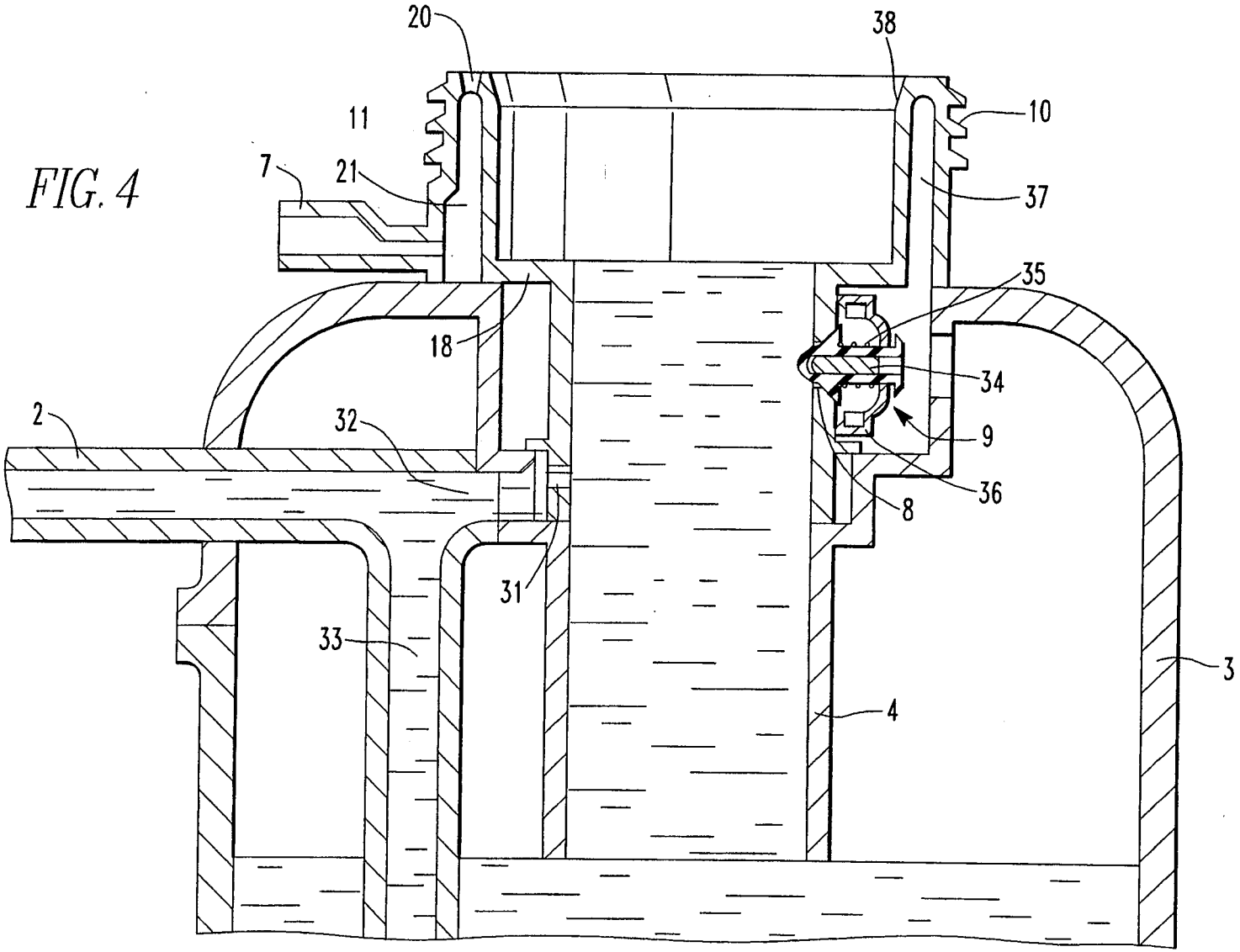
FIG. 4 shows the balance container of, FIG. 2 in section, the filler mouthpiece being open.

FIGS. 2 and 3 show the balance container 3, partially in section, the filler mouthpiece 4 being closed by means of the closing cap 5, which can be screwed onto the filler mouthpiece by means of a thread 10. A cylindrical insert 11, which is matched in shape to the filler mouthpiece 4, is connected to the closing cap 5 with a gap 12 remaining between the insert 11 and the filler mouthpiece 4 being sealed by sealing rings 13 arranged around the insert 11. The two-stage valve arrangement 6 is integrated into the upper part of the insert 11. This valve arrangement 6 consists of a valve spring 14, a first valve plate 15 and a second valve plate 16 and a U-shaped sealing lip 17 surrounding the edge of the second valve plate 16. The two valve plates 15, 16 are received in the valve spring 14 supported on the closing cap 5 such that the two valve plates 15, 16 are pressed by the force of the valve spring 14 against a shoulder 18 forming a valve seat, the two arms of the U-shaped sealing lip 17 separating the lower region of the filler mouthpiece 4 in a gas-tight manner from an annular chamber 19. The annular chamber 19 is in turn connected to the overflow 7 by means of, holes 20 and a first chamber 21.

Both valve plates 15, 16 have center openings with a vacuum valve 22 being provided between the two valve plates 15, 16. The vacuum valve 22 consists of a further valve plate 23, which is pressed onto the first valve plate 15, forming a valve seat, by means of a valve spring 24 supported on the second valve plate 16.

An annular collar 25 is arranged on the inside of the lower region of the insert 11. This annular collar 25, jointly with the valve arrangement 6, defines a float chamber 26 receiving a float 28 provided with a further sealing lip 27, the float 28 being configured in such a way that a gap 29 remains between the float 28 and the insert 11. In addition the insert 11 includes in the region of the float chamber 26 a hole 30 providing for communication between the gap 29 and the gap 12. Finally, the insert 11 has a further hole 31, which provides for communication between the filler mouthpiece 4 and a first branch 32 of the fill hose 2. A second branch 33 of the fill hose 2 extends into the lower region of the balance container 3. The sealing rings 13 are arranged on the periphery of the insert 11 in such a way that the holes 20, 30, 31 are not in low communication via the gap 12 when the insert 11 is inserted but are, rather, separated from one another in a gas-tight manner.

The ventilation opening 8 arranged in the upper region of the balance container 3 can be opened or closed by means of the flow control element 9. The flow control element 9 consists of an arrowhead-shaped conical valve body 34 whose point is pressed into the funnel-shaped ventilation opening 8 by means of a spring 35, which is supported on a retention clip 36 fastened to the filler mouthpiece 4. Adjacent the ventilation opening 8 there is provided a second chamber 37, which is not connected to the first chamber 21.

Operation of the arrangement according to the invention is explained below using FIGS. 1 to 4, FIG. 4 showing the balance container 3 of FIG. 2 with the insert 11 removed from the filler mouthpiece 4. During operation of the internal combustion engine, the cooling fluid can expand due to heating to such an extent that the coolant level reaches the level shown in FIG. 2. Because the filler mouthpiece 4 is immersed in the cooling fluid in this condition, the gas volume located in the upper region of the balance container 3 is separated from the gas volume in the filler mouthpiece 4. Because the flow control element 9 is opened when the insert 11 is inserted, pressure balance can take place between the two gas volumes via the ventilation opening 8, the gap 12 and the hole 30 in the float chamber 6. Therefore, the same pressure is present in all the gas volumes even if the coolant level rises above the bottom of the mouthpiece 4. The exchange of coolant between the radiator 1 and the balance container 3 takes place via the second branch 33 of the filling hose 2 because the first branch 32 is closed by the insert 11.

When the pressure in the gas volume exceeds a first opening pressure $P_1$ as determined by the valve spring 14, the first valve plate 15 is lifted, because of a greater effective area, from the second valve plate 16 and the pressure in the gas volume is released via the annular chamber 19, the holes 20, the first chamber 21 and the overflow 7 until the pressure has again fallen below the opening pressure $P_1$. The center opening of the first valve plate 15 is closed during this process by the valve plate 23 of the vacuum valve 22. When the coolant cools down, and in the process, its volume becomes smaller, a vacuum can be generated in the balance container 3. However, when the pressure becomes less than a limit pressure $P_u$ as determined by the valve spring 24, the valve plate 23 is lifted from the valve plate 15 against the force of the valve spring 24, thereby providing for connection between the enclosed gas volume and atmosphere.

If the coolant level rises further, coolant increasingly enters the float chamber 26 via the filler mouthpiece 4 and the ventilation opening 8. As a result, the float 28 is lifted from the annular collar 25 and rises with the coolant level until such time as it comes into contact with the second valve plate 16 and, by means of the sealing lip 27, closes the opening and therefore encloses a gas volume at the opening pressure $P_1$. Since the effective cross-section of the second valve plate 16 is smaller than that of the first valve plate 15 the opening pressure $P_2$ of the second excess pressure valve 16 is higher than the first opening pressure $P_1$. This means that, in the case of a high cooling fluid level where cooling fluid may be released from the balance container 3, the valve arrangement 6 only opens at a higher opening pressure $P_2$.

When the closing cap 5 is opened, it is necessary to insure that the balance container 3 is first ventilated via the overflow 7 and that the closing cap 5 can only be completely opened and removed when the excess pressure has decayed and there is no longer any danger of hot steam or hot cooling water emerging from the filler mouthpiece 4. For this purpose, the filler mouthpiece 4 has a cross-sectional area 38 at its upper end which increases conically upwards, the uppermost sealing ring 13 being in contact with the filler mouthpiece wall adjacent the beginning of the conically increasing area 38 when the closing cap 5 is closed. As a result, the gap 12 is sealed from the overflow in a gas-tight manner when the closing cap 5 is closed so that ventilation can only take place via the valve arrangement 6. When the closing cap 5 is opened, the insert 11 is raised so that the uppermost sealing ring 13 moves into the region of the conically increasing cross-sectional area 38 and, therefore, provides for a passage from the gap 12 to the overflow 7. Consequently, the excess pressure is released from the filler mouthpiece 4 via the hole 30 and from the gas volume via the ventilation opening 8. The thread 10 is configured in such a way that the closing cap 5 cannot be completely opened without a second grip. The time required therefor is sufficient to ventilate the balance container 3.

When the closing cap 5 is removed, the insert 11 with the valve arrangement 6 is withdrawn from the filler mouthpiece 4 at the same time. Consequently, the hole 31 is first unblocked so that the filling hose 2 is in communication with the filler mouthpiece 4. Upon further withdrawal, the ventilation opening 8 is also unblocked so that the valve body 34 is pressed into the ventilation opening 8 by the force of the spring 35 so that the ventilation opening 8 is closed.

When topping up with coolant, the air in the balance container 3 can escape via the filler mouthpiece 4 only until the coolant level reaches the lower edge of the filler mouthpiece 4. Because the ventilation opening 8 is closed by the flow control element 9 when the valve arrangement 6 is withdrawn, the enclosed gas volume is then completely closed off in a gas-tight manner. Consequently, the air can no longer escape during further filling so that the coolant level only continues to rise within the filler mouthpiece 4 until it reaches the level of hole 31. Through this hole 31 and branch 32 and also through the branch 33 the coolant can then flow into the filling hose 2, and therefore into the complete cooling circuit. If this cooling circuit has likewise been filled, the cooling fluid level rises still further in the insert 4 so that the operator can recognize that the maximum cooling fluid level has been reached.

When the filler mouthpiece 4 is closed, the valve body 34, whose point protrudes into the filler mouthpiece 4, is pressed out of the ventilation opening 8 against the force of the spring 34 by the insert 11 and the ventilation opening 8 is therefore unblocked. When the insert 11 is introduced into the filler mouthpiece 4, the flow control element 9 is therefore automatically opened and pressure balance achieved at any time between the gas volume and the filler mouthpiece 4 via the ventilation opening Also, upon opening of the closing cap 8, pressure relief is first achieved in order to protect the operator from the release of hot coolant and only then is the flow control element 9 closed, whereby refilling of the cooling circuit to the appropriate level is insured when topping off with coolant.

Figure 5:
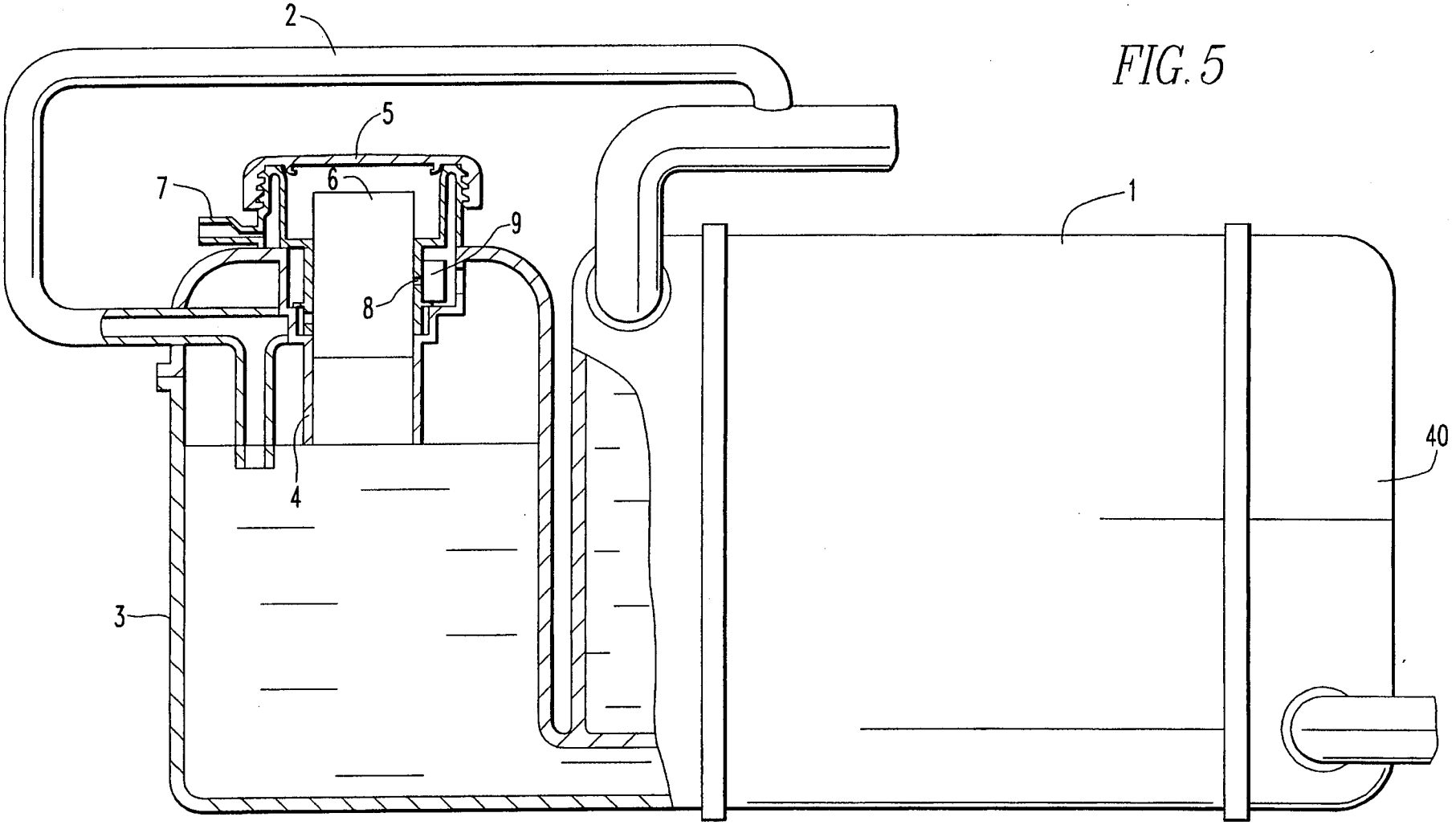
FIG. 5 shows a diagrammatic representation of a further exemplary embodiment.

A further exemplary embodiment of a cooling circuit with an arrangement according to the invention is shown in FIG. 5. In contrast to the first embodiment, the balance container 3 is arranged, in this case, in such a way that the upper edge of the balance container 3 is disposed at the same height as the upper edge of the radiator 1 so that the lower edge of the filler mouthpiece 4 is located below the upper edge of the radiator. In addition, a conduit 39 is provided in this arrangement whereby the lower region of the balance container 3 is directly connected to a water box 40 of the radiator 1 at the suction side of the cooling circuit. Because of the lower suction pressure present in the water box 40, part of the cooling fluid is drawn out of the balance container 3 when the closing cap 5 is open. Consequently, during filling which is done with running engine, there are different fill levels in the balance container 3 and in the radiator 1. If the length of the filler mouthpiece 4 is selected in precisely such a manner that the height difference between the lower edge of the filler mouthpiece 4 and the upper edge of the radiator corresponds to, or is greater than, the suction pipe vacuum present in the water box 40 when the engine is idling, overfilling of the cooling circuit is prevented also with this arrangement. When the filler mouthpiece 4 is closed, the gas volume in the balance container 3 is completely closed of so that a coolant level balance between the balance container 3 and the radiator, and therefore entrainment of air into the cooling circuit as such, is prevented when the engine is switched off.

Besides the exemplary embodiment described herein in which a separate balance container 3 is provided, the arrangement according to the invention can also, of course, be applied to a balance container which is part of the radiator.

What is claimed is:

1. An arrangement for protecting a cooling system of an internal combustion engine from excessive pressure, said system including a coolant container with a filler mouthpiece arranged in the upper region of, and extending into, the coolant container and having at least one pressure operated valve mounted in an insert received in said filler mouthpiece so as to normally close said filler mouthpiece and further having a ventilation opening providing for communication between a gas volume in the coolant container and the filler mouthpiece, and a flow control element arranged in the ventilation opening in such a way that the ventilation opening is closed when the coolant container is being filled so as to interrupt communication between the gas volume in the coolant container and the filler mouthpiece, said flow control element consisting of an arrowhead-shaped conical valve body arranged in the gas volume and having a pointed end disposed in the ventilation opening, a spring engaging said valve body so as to bias said valve body into said ventilation opening such that said pointed end protrudes into the filler mouthpiece where it is engaged by said insert for displacing said valve body so as to open said ventilation opening when said insert is disposed in said filler mouthpiece.

2. An arrangement according to claim 1, wherein said insert includes a second pressure operated valve and said ventilation opening is formed in said filler mouthpiece below said second pressure operated valve.

3. An arrangement according to claim 2, wherein said first pressure operated valve is a plate valve with a predetermined seating area cross-section and a spring designed to permit opening of said first valve by a predetermined first pressure in said cooling system and said second valve is a plate valve with a predetermined seating area cross-section and a spring designed to permit opening of said second valve by a predetermined second pressure in said cooling system which is higher than said first pressure.

4. An arrangement according to claim 3, wherein said second valve is arranged below said first valve and is seated on a shoulder formed in said insert and said first valve is seated on said second valve and is spring-biased onto said second valve, said second valve having a center opening for passage therethrough of pressurized air for lifting said first valve from said second valve when the cooling circuit reaches said predetermined first pressure.

5. An arrangement according to claim 4, wherein said insert includes a float arranged below said second valve and having a seal lip adapted to close the center opening in said second valve when the coolant level rises to lift said float thereby disabling said first valve and providing for lifting of said second valve from said shoulder when the cooling circuit reaches said predetermined second pressure.

6. An arrangement according to claim 5, wherein said first valve has a central opening with a vacuum valve disposed therein biased to a closed position by a valve spring arranged between said first and second valves and adapted to open against the pressure of said valve spring when the vacuum within said cooling system reaches a predetermined value defined by said valve spring.

7. An arrangement according to claim 1, wherein said ventilation opening is arranged in the upper region of the coolant container.

8. An arrangement according to claim 1, wherein said insert is connected to a closing cap covering the filler mouthpiece.

9. An arrangement according to claim 8, including an overflow passage in communication with the area below said closing cap so that, upon opening of said closing cap, the gas volume is ventilated via said ventilation opening and said overflow passage before said insert can be pulled out of the filler mouthpiece.

10. An arrangement according to claim 1, wherein said filler mouthpiece extends downwardly into said coolant container and has a lower edge defining the maximum fill level for said coolant container, said coolant container being arranged in such a way that the maximum fill level as defined by the lower edge the filler mouthpiece is located below the upper end of a radiator, with which said coolant container is associated, said coolant container being in flow communication with a radiator water box at the suction side of the cooling system via a conduit connected to the lower region of the coolant container.

* * * * *

UNITED STATES PATENT AND TRADEMARK OFFICE

CERTIFICATE OF CORRECTION

PATENT NO. : 5,357,909

DATED : October 25, 1994

INVENTOR(S) : Attinger, et al

It is certified that error appears in the above-identified patent and that said Letters Patent is hereby corrected as shown below:

In the Drawings :

Delete Drawing Sheets 1,3, and 5, and substitute therefor the Drawing Sheets, consisting of FIGS. 1,3, and 5, as shown on the attached pages.

Signed and Sealed this

Fourth Day of July, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,357,909

DATED : October 25, 1994

INVENTOR(S) :

Attinger, et al

It is certified that error appears in the above-indentified patent and that said Letters Patent is hereby corrected as shown below:

FIG. 1

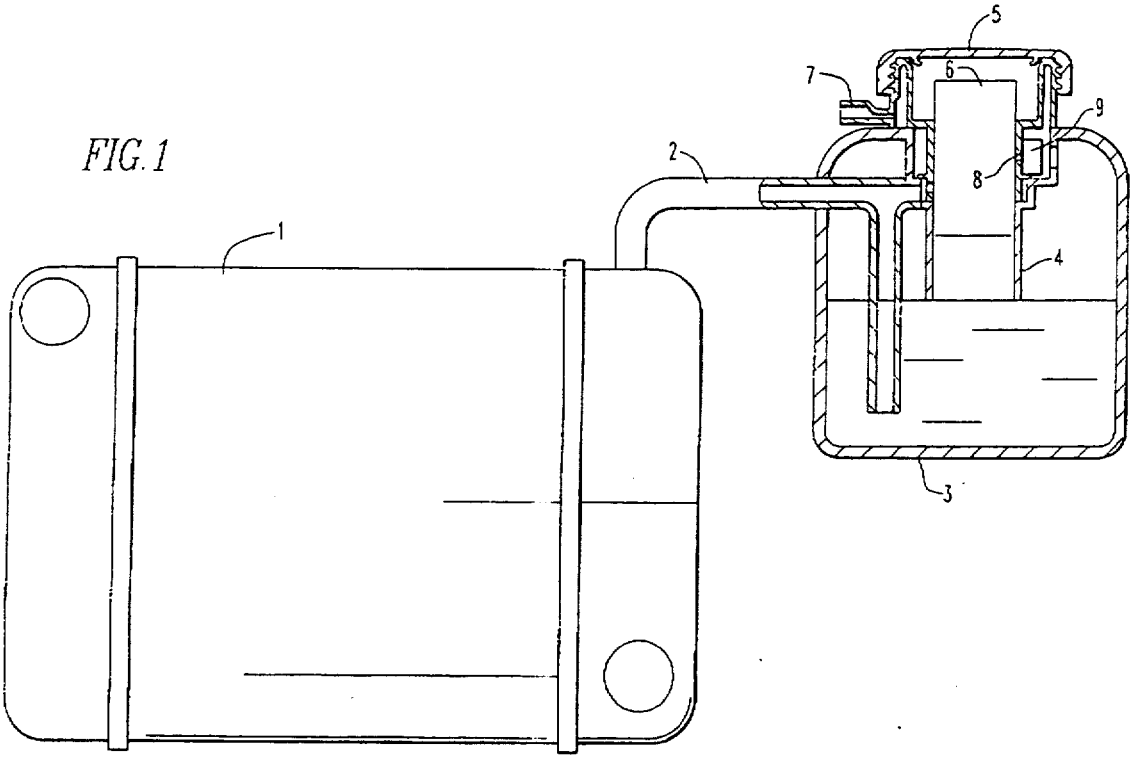

UNITED STATES PATENT AND TRADEMARK OFFICE

CERTIFICATE OF CORRECTION

PATENT NO. : 5,357,909

DATED : October 25, 1994

INVENTOR(S) : Attinger, et al

It is certified that error appears in the above-indentified patent and that said Letters Patent is hereby corrected as shown below:

FIG. 3

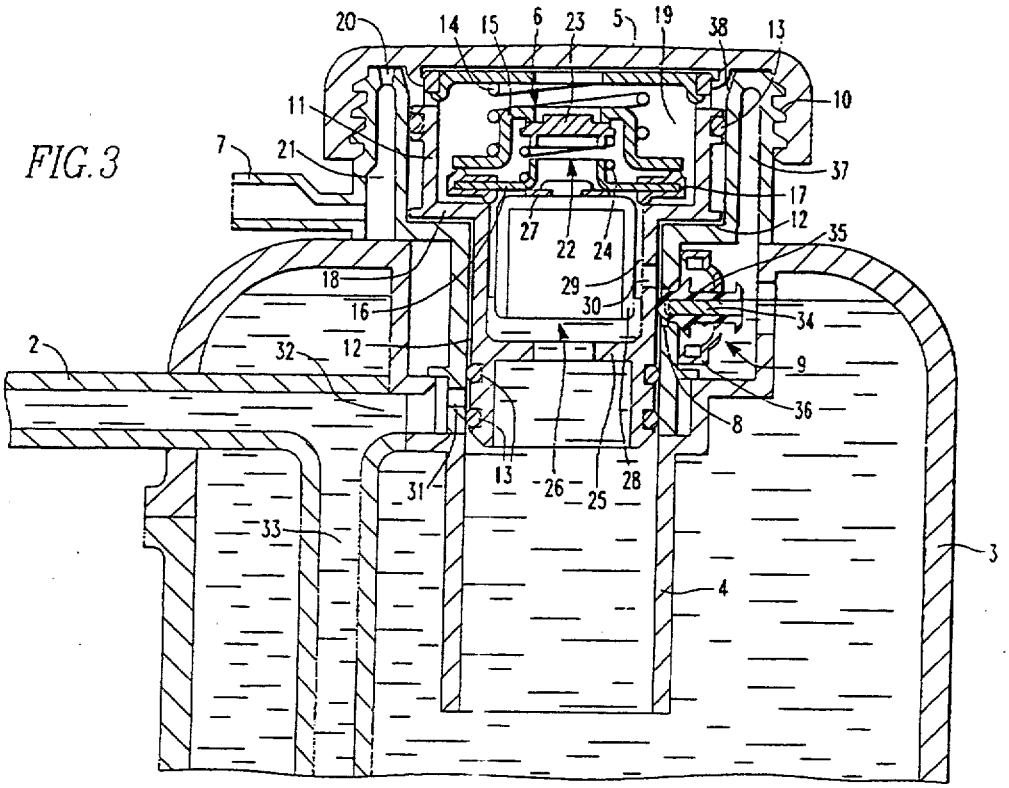

UNITED STATES PATENT AND TRADEMARK OFFICE

CERTIFICATE OF CORRECTION

PATENT NO. : 5,357,909

DATED : October 25, 1994

INVENTOR(S) : Attinger, et al

It is certified that error appears in the above-indentified patent and that said Letters Patent is hereby corrected as shown below:

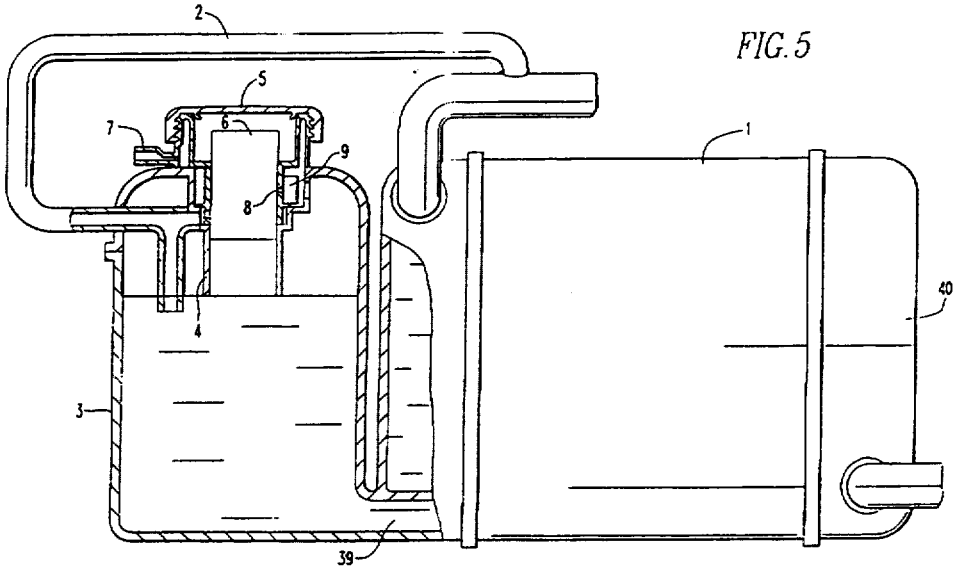

FIG. 5